US006390455B1

(12) United States Patent
Lee et al.

(10) Patent No.: US 6,390,455 B1
(45) Date of Patent: May 21, 2002

(54) BUBBLE GENERATING DEVICE HAVING A FLOAT CONNECTED THERETO

(76) Inventors: Sen-Yung Lee, 9F, No. 84, Section 3, Chang-Rong Road; Sheng-Jye Hwang, No. 28, Alley 1, Lane 176, Dong-An Road; Shueei-Muh Lin, No. 17, Lane 99, Ming-Shin Road, all of Tainan City; Hsin-Mao Hsieh, No. 6, East Section, Industrial Sixth Road, Pin-Tong City, all of (TW)

( * ) Notice: Subject to any disclaimer, the term of this patent is extended or adjusted under 35 U.S.C. 154(b) by 0 days.

(21) Appl. No.: 09/725,913

(22) Filed: Nov. 30, 2000

(51) Int. Cl.[7] ..... B01F 3/04
(52) U.S. Cl. ..... 261/120; 261/122.1; 210/242.2
(58) Field of Search ..... 261/120, 122.1, 261/122.2; 210/242.2

(56) References Cited

U.S. PATENT DOCUMENTS 3,048,339 A * 8/1962 Tapleshay ..... 261/122.1
3,193,260 A * 7/1965 Lamb ..... 261/120
4,070,423 A * 1/1978 Pierce ..... 210/242.2
5,851,448 A * 12/1998 Tyer ..... 261/122.1
5,938,983 A * 8/1999 Sheaffer et al. ..... 261/122.2

FOREIGN PATENT DOCUMENTS

FR 2398024 * 3/1979 ..... 210/242.2

* cited by examiner

*Primary Examiner*—C. Scott Bushey
(74) *Attorney, Agent, or Firm*—Rosenberg, Klein & Lee

(57) ABSTRACT

A bubble generating device includes a shaft connected to a float and a plurality of frames connected to the bolt at their first ends. A porous device is connected to the respective mediate portions of the frames. A bolt extends through respective second ends of the frames and a weight is connected to the bolt. A pipe is connected to a fitting extending from the porous device so as to provide air into the porous device to generate bubbles. The bubble generating device can be maintained in water by adjusting the float and the weight.

4 Claims, 7 Drawing Sheets

BUBBLE GENERATING DEVICE HAVING A FLOAT CONNECTED THERETO

FIELD OF THE INVENTION

The present invention relates to a bubble generating device having a float and a weight to maintain the device in a desired position in the water.

BACKGROUND OF THE INVENTION

A conventional bubble generating device is shown in FIG. 1 and generally includes a two blade means 101 driven by a motor 100. The bubble generating device is floated on water such as a pond, and the blade means 101 rotated to splash water in the air so that the water become many tiny water drops and fall into the water so as to increase the oxygen in the water. However, the bubble generating device cannot bear strong wind and the blades of the blade means 101 can only affect the water on the top surface of the water. FIG. 2 shows another bubble generating device which has two blades 102 on a shaft 103 and the device can be sunk in water. The blades 102 stir the water in the casing 104 of the device to generate bubbles. This is a bulk device and requires a motor to drive the shaft and a gear reduction device to adjust the speed of the shaft. This is costly and the device cannot operate in deep water.

SUMMARY OF THE INVENTION

In accordance with one aspect of the present invention, there is provided a bubble generating device and includes a shaft connected to a first float and a plurality of frames are connected to the shaft at there respective first ends. A porous device has a plurality of lugs extending therefrom and is connected to mediate portions of the frames by bolts. A fitting extends from the porous device and is connected to a pipe.

The primary object of the present invention is to provide a bubble generating device that can be operated in desired depth of water and the has a simple structure.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
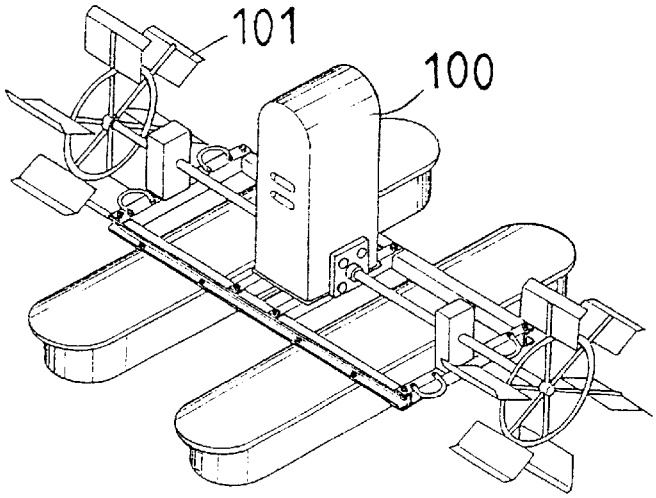
FIG.1 PRIOR ART
FIG. 1 shows a conventional bubble generating device.
Figure 2:
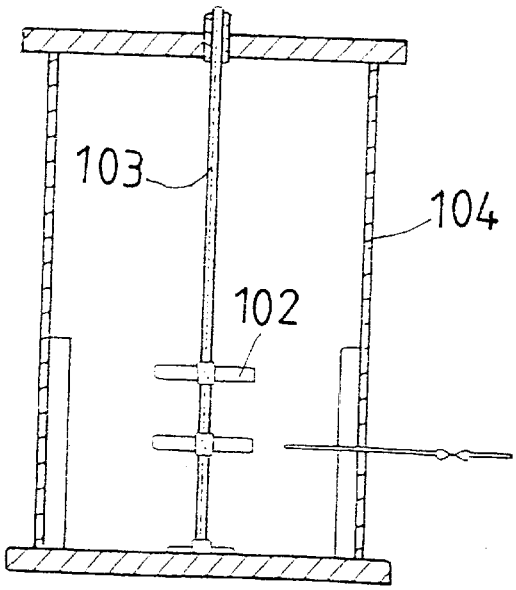
FIG.2 PRIOR ART
FIG. 2 is a cross sectional view to show another conventional bubble generating device.
Figure 3:
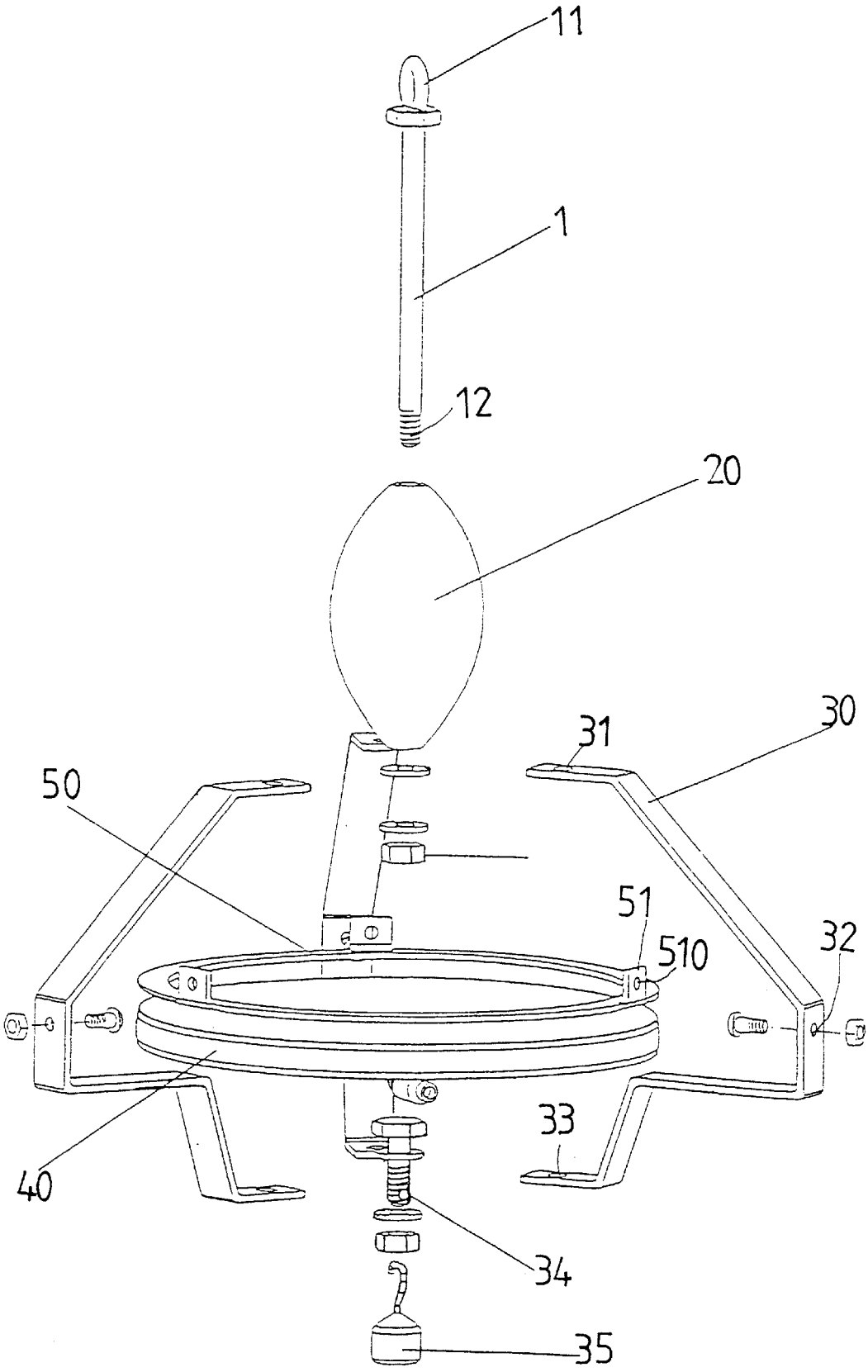
FIG. 3 is an exploded view to show the bubble generating device of the present invention.
Figure 4:
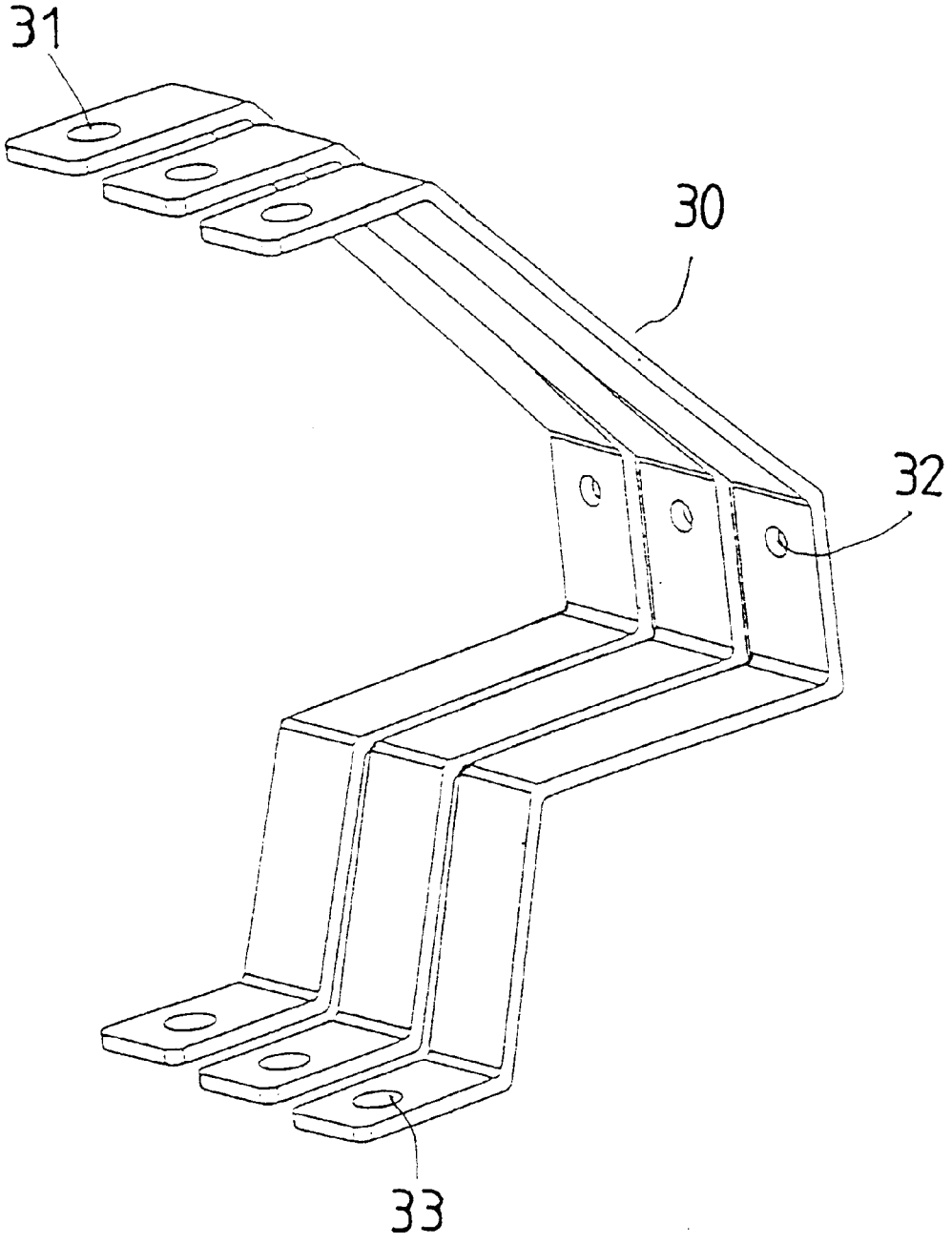
FIG. 4 is a perspective view to show the frames in the bubble generating device of the present invention.
Figure 5:
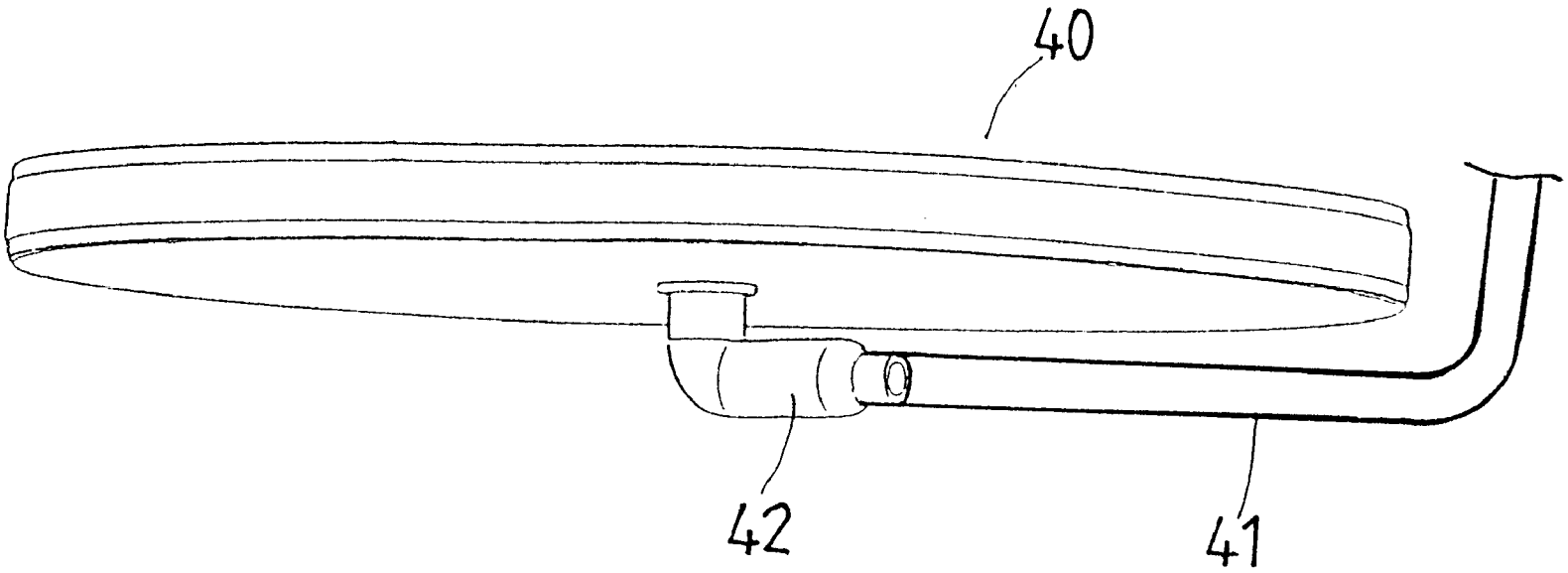
FIG. 5 is a perspective veiw to show the porous device of the bubble generating device of the present invention.

Referring to FIGS. 3 to 5, the bubble generating device of the present invention comprises a shaft 1 connected to a first float 20 and a threaded section 12 is defined in a lower end of the shaft 1. A plurality of frames 30 each have a first hole 31 defined in a first end thereof and a second hole 32 defined in a mediate portion of each frame 30. The threaded section 12 extends through the float 20 and the three first holes 31 and engaged with a nut. A hole 11 is defined in a top of the shaft 1 so that a cable 13 tied with the hole 11 to hang the device.

A porous device 40 for generating bubbles is enclosed by the frames 30 and a pressing ring 50 located on a top surface of the porous device 40. A plurality of lugs 51 extend from the pressing ring 50 and each lug 51 has a hole 510. A plurality of first bolts extend through the respective second holes 32 in the frames 30 and the holes 510 in the lugs 51 to connect the porous device 40 to the frames 30. A third hole 33 is defined through a second end of each frame 30 and a second bolt 34 extends through the third holes 33 of the frames 30 and is engaged with a first weight. 35. A fitting 42 extends from the porous device 40 and is connected to a pipe 41 so that when air is introduced in the porous device 40 via the pipe 41 from a source of air, bubbles are generated by the porous device 40.

Figure 6:
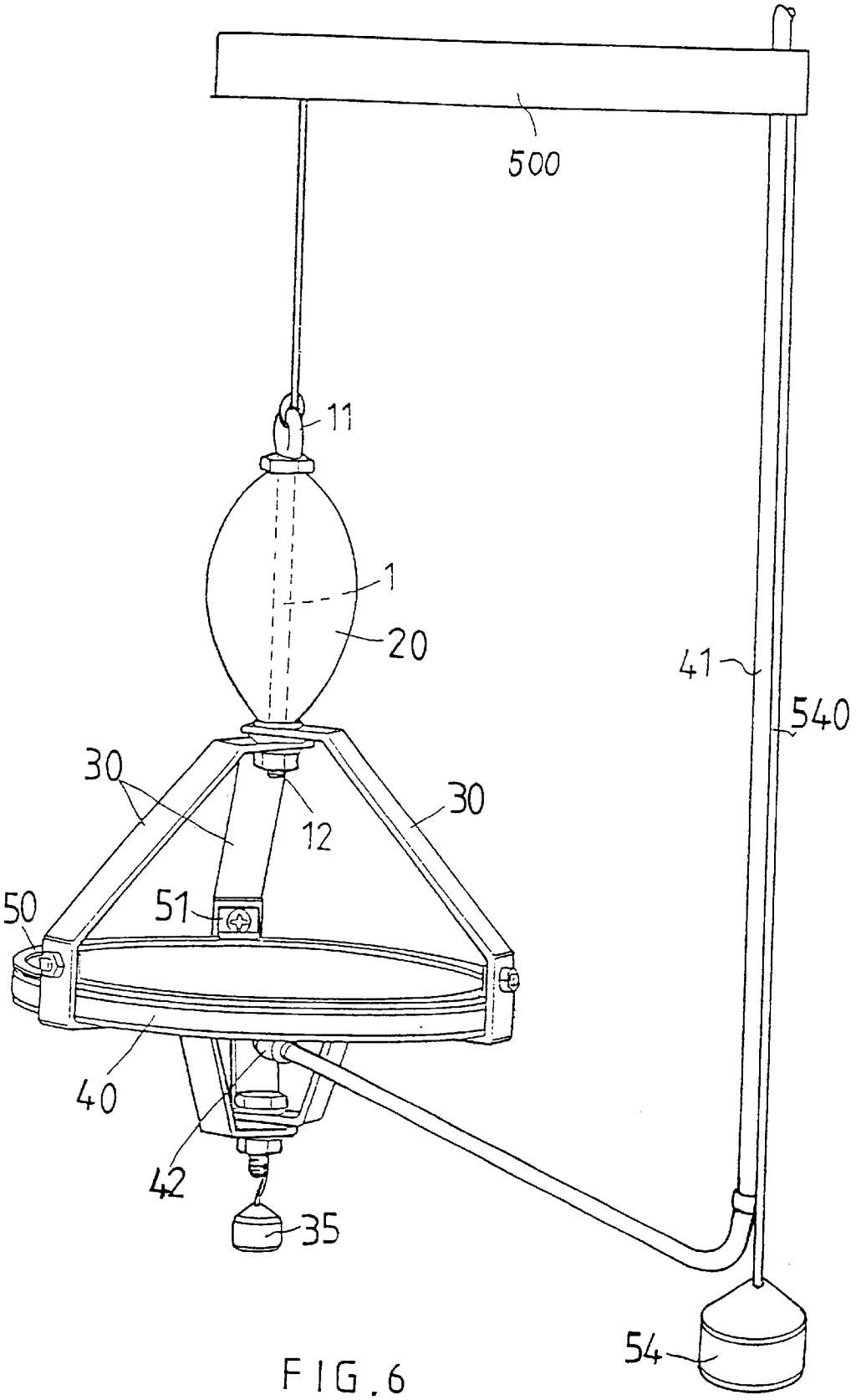
FIG. 6 is a perspective view to show another embodiment of the bubble generating device of the present invention.

As shown in FIG. 6, a second float 500 is connected to the cable extending from the shaft 1 and a second weight 54 is hung on the second float 500 by a cable 540. The pipe 41 is attached to the cable 540 so as to reduce the possibility of affection of the bubble generating device by the un-positioned pipe 41.

Figure 7:
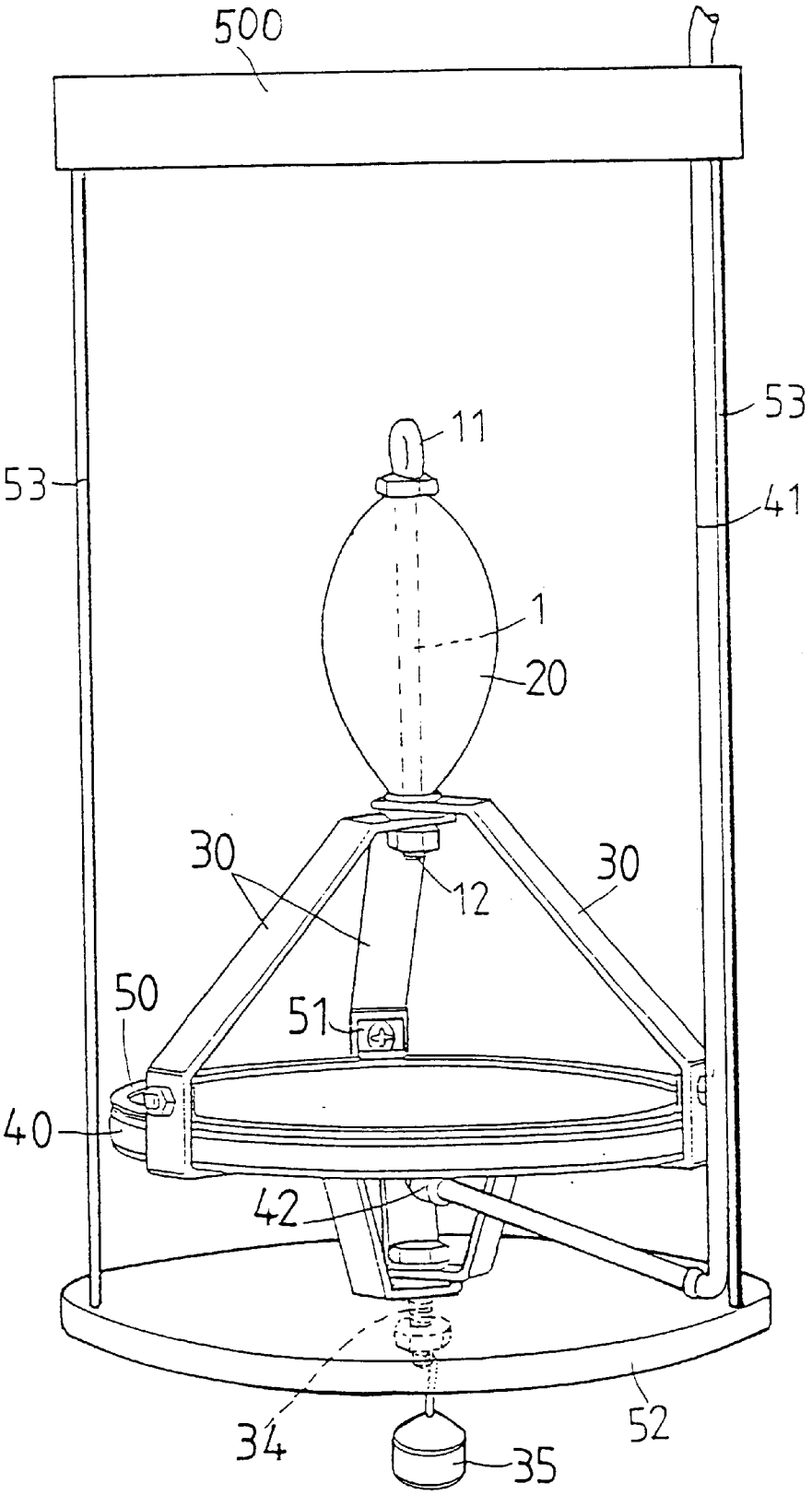
FIG. 7 is a perspective view to show yet another embodiment of the bubble generating device of the present invention.
Figure 8:
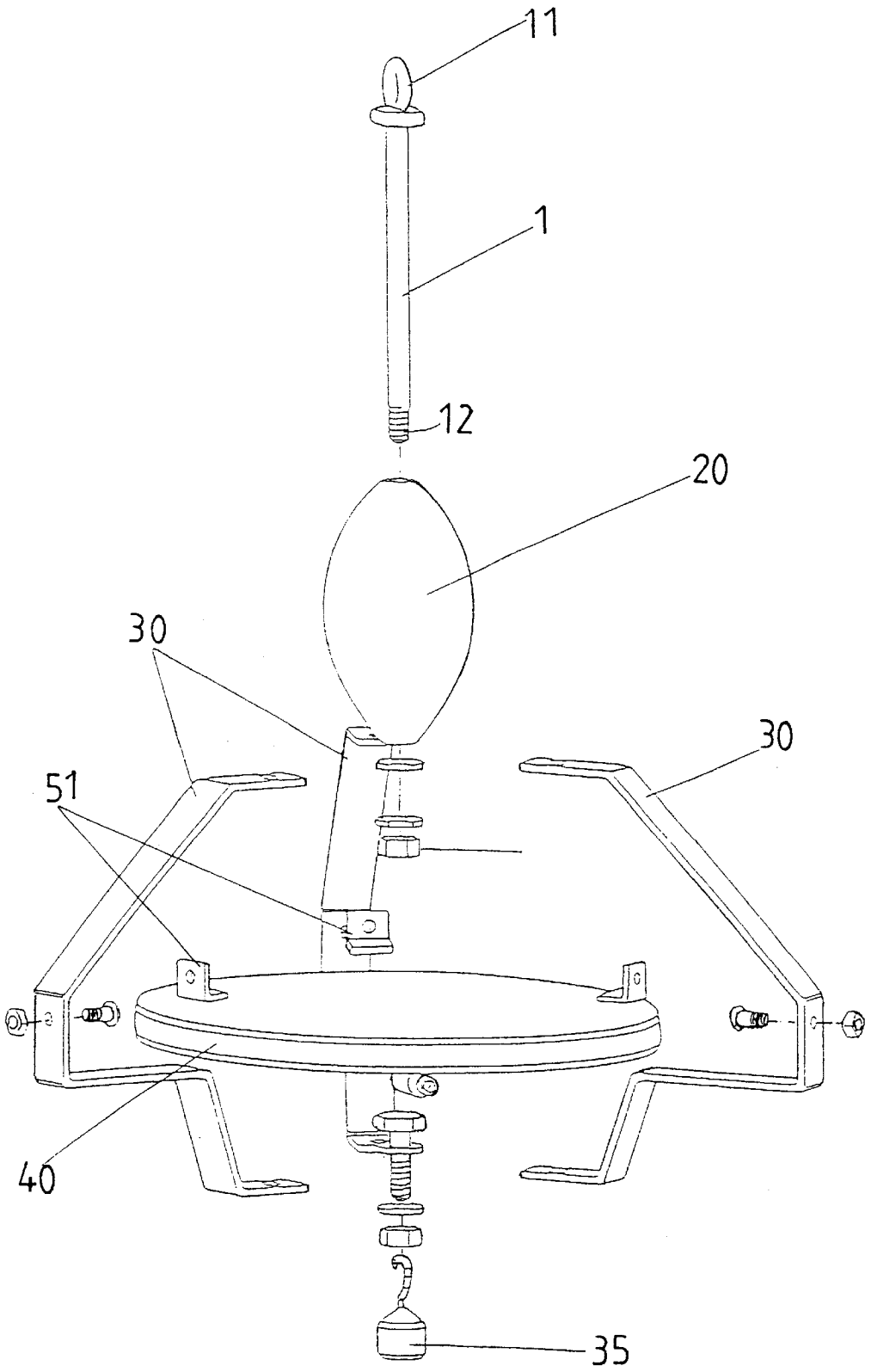
FIG. 8 is an exploded view to show another embodiment of connection between the frames and the porous device.

FIG. 7 shows a weight board 52 is located below the porous device 40 and posts 53 extend from the board 52. The second float 500 is connected to the posts 53 so that the porous device 40 is located between the board 52 and the second float 500. The second bolt 34 extends through the board 52 and the first weight 35 is hung below the board 52. This structure allows the bubble generating device to be operated in a deep and wavy water. The lugs 51 can also be made integrally with the porous device 40.

The device can be lowered into water because the weight 35/52 and the float 20/51 provides an upward force so that the device can be stayed at a desired depth in the water. The float 20/51 ensures the top surface of the porous device 40 always to face upward. By this way, the device can be operated in water and will not be affected by strong wind because only the cable is exposed out of the water.

While we have shown and described various embodiments in accordance with the present invention, it should be clear to those skilled in the art that further embodiments may be made without departing from the scope and spirit of the present invention.

What is claimed is:

1. A bubble generating device comprising:

a shaft connected to a first float;

a plurality of frames each having a first hole defined in a first end thereof and a second hole defined in a mediate portion of each frame, and a porous device having a plurality of lugs extending therefrom and first bolts extending through said respective second holes in said frames and said lugs to connect said porous device to said frames, said porous device adapted to be submerged into water, and a fitting extending from said porous device and connected to a pipe which is adapted to be connected to a source of air.

2. The device as claimed in claim 1 wherein a third hole is defined through a second end of each frame and a second bolt extends through said third holes of said frames, a first weight connected to said second bolt.

3. The device as claimed in claim 1 further comprising a second float connected to a first cable and a second weight hung on said second float by a second cable, said pipe attached to said cable.

4. The device as claimed in claim 3 further comprising a board with posts extending therefrom, said second float connected to said posts and said porous device located between said board and said second float, a second bolt extending through said board and a first weight connected to said second bolt.

* * * * *